United States Patent [19]

Reister

[11] Patent Number: 4,500,147

[45] Date of Patent: Feb. 19, 1985

[54] REFRIGERATOR SHELF DOORS

[76] Inventor: Richard A. Reister, Rte. 1, Box 124H, Tryon, Okla. 74875

[21] Appl. No.: 476,139

[22] Filed: Mar. 17, 1983

[51] Int. Cl.[3] ..... A47B 77/04

[52] U.S. Cl. ..... 312/291; 312/319; 312/328

[58] Field of Search ..... 312/236, 138 R, 138 A, 312/319, 291, 292, 328

[56] References Cited

U.S. PATENT DOCUMENTS

| | | | |
|---|---|---|---|
| 1,170,660 | 2/1916 | Morris | 312/138 R |
| 1,630,160 | 5/1927 | Bayless | 312/291 |
| 1,698,509 | 1/1929 | Probert | 312/291 |
| 2,051,733 | 8/1936 | Moore et al. | 312/291 X |
| 2,062,856 | 12/1936 | Armbruster | 312/291 X |
| 2,124,857 | 7/1938 | MacGrath | 312/291 X |
| 2,321,921 | 6/1943 | Lathrop | 312/291 |
| 2,381,598 | 8/1945 | Jones | 312/291 |
| 2,565,129 | 8/1951 | Hermani | 312/328 |
| 3,204,545 | 9/1965 | Benson | 312/236 X |
| 4,225,203 | 9/1980 | Goodrode | 312/236 |

FOREIGN PATENT DOCUMENTS

| | | | |
|---|---|---|---|
| 1003 | 3/1936 | Australia | 312/291 |
| 532274 | 10/1956 | Canada | 312/138 R |
| 486935 | 11/1927 | Fed. Rep. of Germany | 312/138 R |
| 1047223 | 12/1958 | Fed. Rep. of Germany | 312/291 |
| 1128862 | 1/1957 | France | 312/291 |

*Primary Examiner*—William E. Lyddane
*Assistant Examiner*—Thomas A. Rendos

[57] ABSTRACT

The present invention relates to convenient, economical, and attractive means to easily convert any Refrigerator, Freezer, or Side by Side Refrigerator-Freezer Combination to Individual Shelf Doors to avoid loss of cold air upon opening the Refrigerator or Freezer doors, thus saving energy, maintaining the Refrigerator or Freezer at more stable normal operating temperatures, providing convenience in opening the Refrigerator or Freezer doors since it is not necessary to be in a hurry to reclose the doors to avoid loss of cold air in the Unit, and enhancing the attractive appearance of the Unit.

16 Claims, 10 Drawing Figures

REFRIGERATOR SHELF DOORS

The conventional Refrigerator, Freezer, of Side by Side Refrigerator-Freezer Combination loses a good deal of cold air upon opening the Refrigerator or Freezer doors since cold air is heavier than warm air, causing the cold air to slide out of the Refrigerator or Freezer and be replaced by the warm air in the room when the Refrigerator or Freezer doors are opened. Therefore the present invention provides convenient, economical, and attractive plastic transparent doors for each individual shelf in the Refrigerator or Freezer to contain the cold air in the Unit when the normal outside doors are opened. The present invention also provides a unique arrangement of said transparent plastic shelf doors whereby the top of each shelf door means is recessed inwardly behind the front edge of the individual shelf means immediately above, hinge means at the bottom of each individual shelf door means being at the front edge of the individual shelf means to which it is attached, thereby placing the shelf door means in an inclined position when closed. The recessment of the top of each shelf door means inwardly behind the front edge of the individual shelf means immediately above provides a unique enhancement in the appearance of said individual shelf door means and the refrigeration unit, provides gravity action to keep the individual shelf door means in a closed position, and provides convenient space for a handle near the top of said shelf door means within said refrigeration units when said normal outside doors of said refrigeration units are in a closed position. The top of each individual shelf door means rests against a doorstop which also provides an air seal to effectively restrict loss of air from the refrigeration unit when the normal outside doors are opened. Thus the food in the Refrigerator or Freezer is attractively displayed through the individual transparent doors on each shelf when the normal outside doors are opened, allowing convenient selection of the particular food to be removed through the appropriate transparent plastic door, opening of the appropriate transparent plastic door providing a minimal loss of cold air from the Unit.

The present invention may be used to easily and economically convert any Refrigerator, Freezer, or Side by Side Refrigerator-Freezer Combination to the described individual shelf doors, or the individual shelf doors may be easily installed at the factory, and installation may be easily made without drilling into the Refrigerator or Freezer. Various dimensions of the transparent plastic shelf doors would be provided to accommodate different sizes of Refrigeration Units and different heights of the individual shelves in the Refrigeration Units.

To convert the conentional Refrigerator or Freezer, the transparent shelf doors may be attached by hinges at the bottom and inclined inward about 2" at the top to rest against a door stop at the top, so that the inclined position holds the plastic doors closed against the doorstop by gravity to seal the transparent doors from loss of cold air when the normal outside doors of the Refrigerator or Freezer are opened. The inclined position also enhances the attractive appearance of the plastic doors. An attractive handle at the top of the transparent doors provides convenient opening and closing, and the inclined position of the individual shelf doors recesses the handle to prevent obstruction with the normal outside Refrigerator door, when closed. Transparent, plastic, individual shelf doors are also provided with hinge means at the top, a slightly inclined position maintaining the doors closed by gravity against the shelf below.

The hinges at the bottom of the plastic doors are so designed that when the doors are fully opened, the edge of the transparent doors extends below the shelf, thus preventing any obstruction with food being removed from the shelf which might break the plastic doors.

The plastic doors have sufficient side, top, and bottom clearance in the Refrigerator or Freezer to provide sufficient interior air circulation to the normal outside Refrigerator or Freezer door when closed to maintain proper refrigeration temperatures to foods stored in the outside Refrigerator or Freezer doors.

Means are provided for conveniently attaching the individual transparent shelf doors to different types of shelves in conventional Refrigerators, Freezers, or Side by Side Refrigerator-Freezer Combinations.

It is accordingly one of the objects of the present invention to provide simple economical plastic transparent doors for each individual shelf in a Refrigerator, Freezer, or Side by Side Refrigerator-Freezer Combination.

Another object of the present invention is to provide means for conveniently and easily attaching said transparent plastic doors to any conventional said Refrigerator or Freezer, either at home or in the Factory.

A further object of the present invention is to provide means for conveniently and easily attaching said individual transparent shelf doors to different types of shelves in said Refrigeration Units.

Another object of the present invention is to provide means for inclining said transparent doors when in the closed position, so that they are held closed by gravity.

A further object of the present invention is to provide means for preventing the loss of cold air from a Refrigerator or Freezer when the normal outside doors of the Refrigerator or Freezer are opened.

Another object of the present invention is to enhance the attractive appearance of a Refrigerator or Freezer by the use of said transparent, plastic, individual shelf doors.

A further object of the present invention is to provide means to lower the edge of said transparent plastic doors below shelf level when fully opened, to prevent obstruction with food being removed from the shelf which may cause accidental breakage of said transparent plastic doors.

Another object of the present invention is to provide attractive means to conveniently open and close each individual transparent shelf door.

A further object of the present invention is to provide various dimensions of said transparent plastic shelf doors to accomodate different sizes of Refrigerators or Freezers and different heights of shelves within said Refrigerators or Freezers.

Another object of the present invention is to provide proper refrigeration temperatures to foods stored in the normal closed outside Refrigerator or Freezer door, after installation of said transparent individual shelf doors.

Other desirable features and advantages of the invention will appear more fully hereinafter from the following detailed description when taken in connection with the accompanying drawings illustrating one form of the invention. It is to be expressly understood, however, that the drawings are utilized for purposes of illustration only and are not to be taken as a definition of the limits of the invention, reference being had for this purpose to the specification and appended claims.

In the drawings, wherein similar reference characters refer to like parts throughout the several views.

While the description herein considers the instant invention as applied to Refrigerators and Freezers, it is to be understood that the present invention also relates to the novel features or principle of the instrumentalities described herein, whether or not such are used for the stated objects, or the stated fields or combinations.

Figure 1:
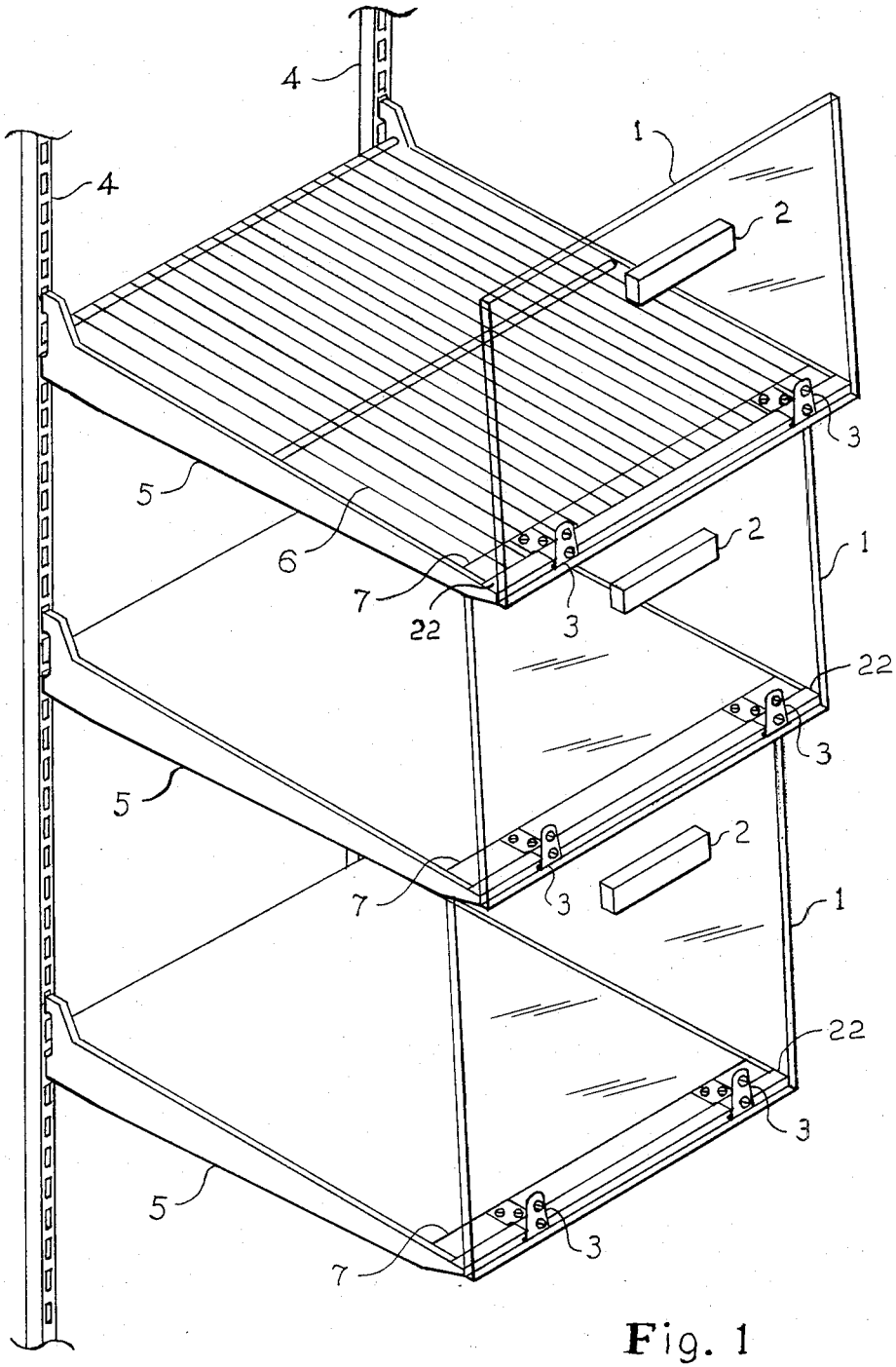
FIG. 1 is a perspective view of refrigerator shelves with the transparent plastic shelf doors attached.

FIG. 1 illustrates the typical Refrigerator, where cantilever shelves 5 may be adjusted in height on vertical supporting rails 4, lugs at the rear of the shelves 5 engaging holes in the supporting rails 4, so that the position of the shelves may be raised or lowered in increments of 1". Thus various sizes of transparent plastic doors 1 would be provided to accommodate different widths of Refrigerators and desired dimensions between individual shelves. FIG. 1 illustrates the hinges 3 at the bottom of the transparent plastic individual shelf doors, the inclined position of the plastic doors 1 from the vertical, and the convenient handle 2 with which to open or close the doors. Handles 2, rectangular in shape as illustrated, may be of wood, plastic, metal, or transparent plastic, attached to the plstic doors 1 by appropriate metal or wood screws near the top of the plastic doors 1 in a central position as illustrated. Handles 2 might also be of transparent plastic, integrally molded or glued on plastic doors 1. FIG. 1 illustrates the attractive appearance of such transparent plastic doors for individual shelves.

Figure 2:
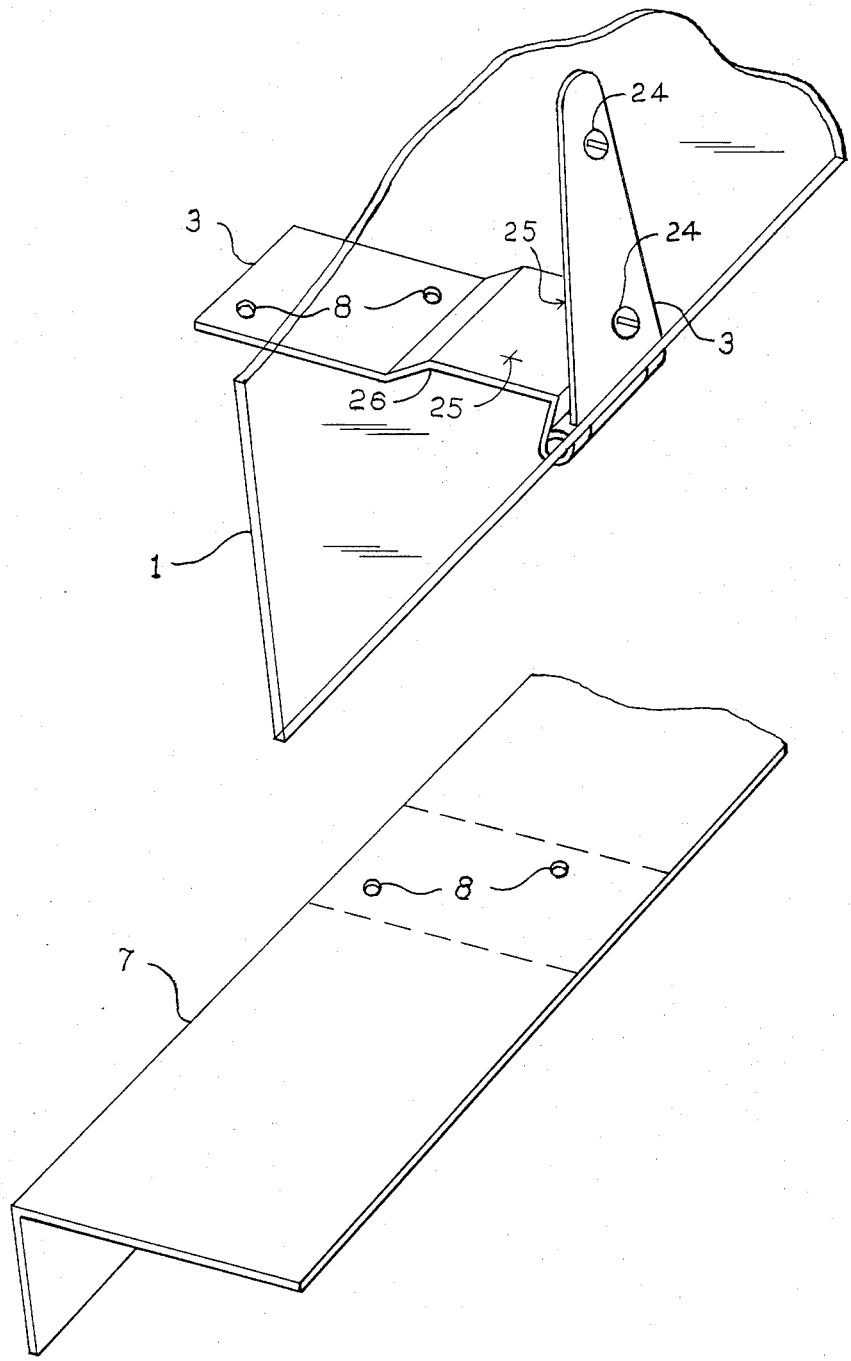
FIG. 2 is a perspective detail of the plastic door hinges and doorstop, illustrating one means of attaching the plastic doors to the individual refrigerator shelves.

FIG. 2 illustrates a detail of the means to attach the plastic doors 1 to the individual shelves. Hinges 3 are offset at the front of bend 26 as illustrated to fit over a metal decorative cap 22 at the front of shelves 5 in FIG. 1. Metal cap 22 might be removed from the shelves 5, thus eliminating the need for the offset in hinges 3, however the decorative appearance of metal cap 22 would likely be preferred. Hinges 3 in FIG. 2 have two holes 8 through which bolts are placed to attach hinges 3 to shelf 5 in FIG. 1, the plastic doors 1 being attached to the front side of hinges 3 by two appropriate bolts 24 with nuts as illustrated in FIG. 2. The doorstop 7 is an L-shaped member as illustrated in FIG. 2, being made of metal, plastic, or transparent plastic, with holes 8 matching holes 8 in hinges 3 to properly position two hinges 3 on each shelf 5 as illustrated in FIG. 1. A transparent plastic doorstop 7 might be preferred due to its greater visibility. Hinges 3 are thus placed on top of wire grid 6 of shelf 5 in FIG. 1, and doorstop 7 of FIG. 2 is placed beneath the wire grid 6 of shelf 5 in FIG. 1, with bolts passing through matching holes 8 in hinges 3 and doorstop 7 of FIG. 2, into nuts beneath doorstop 7 securely attaching hinges 3 and doorstop 7 to the shelves of FIG. 1. Metal screws might replace bolts in holes 8, although bolts and nuts would likely be preferred. The wire grid 6 of shelf 5 in FIG. 1 is thus sandwiched between hinges 3 and doorstop 7 of FIG. 2, a single wire of grid 6 passing between the two holes 8 in hinges 3 and doorstop 7. Although hinges 3 might be wide enough to straddle two adjacent wires of grid 6 of shelf 5 in FIG. 1, with holes 8 then being located between the two straddled adjacent wires of grid 6 of FIG. 1.

Figure 3:
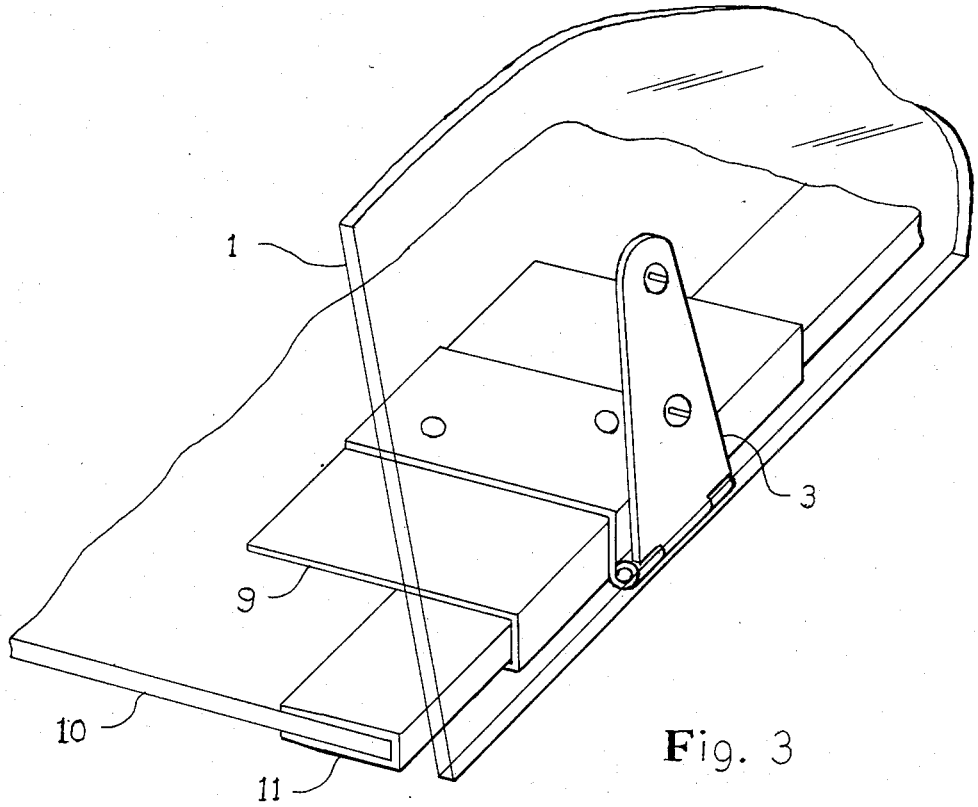
FIG. 3 is a perspective detail illustrating another means of attaching the hinges of the plastic door to the bottom glass shelf in a refrigerator immediately above the crisper drawers.

The typical Refrigerator has three adjustable cantilever shelves 5 as illustrated in FIG. 1. For purposes of illustration only the top shelf 5 is shown with wire grid 6, although it is to be understood the other two cantilever shelves 5 similarly have wire grids 6. Doorstop 7 extends across the full width of the shelves 5, although the doorstop 7 on the top and bottom cantilever shelves 5 may be shortened in length to leave about a 1½" air gap between the two ends of doorstop 7 and the two cantilever side pieces of shelves 5, to provide additional interior air circulation to foods stored in the normal outer Refrigerator door when closed. A bottom fixed glass shelf 10, illustrated in FIG. 3, is located below the lower cantilever shelf 5 in FIG. 1.

The front part of hinges 3 in FIG. 2 is bent downward at a 90° or greater angle as illustrated so that the hinge line of hinges 3 is near the bottom of metal cap 22 of shelf 5 in FIG. 1, the bottom edge of plastic door 1 in FIG. 2 being located slightly above the hinge line of hinges 3 as illustrated. Thus when plastic door 1 of FIG. 1 is fully opened, the bottom edge of plastic door 1 does not protrude above grids 6 of shelf 5 to catch on objects being removed from shelf 5, thus preventing accidental breakage of plastic doors 1. The position of the bottom edge of plastic door 1 near the bottom of metal cap 22 of shelves 5 in the closed position as illustrated also provides a more attractive appearance than if the bottom edge of plastic doors 1 extended above wire grids 6 of shelves 5 in FIG. 1. If hinges 3 were not bent down at the front at a 90° angle as illustrated, the bottom edge of plastic doors 1 would have to be positioned on hinges 3 above shelf 5 in the closed position, so that when fully opened the bottom edge of plastic doors 1 would fall below shelf 5, and it is believed this would not be as desirable or attractive as bending the front edge of hinges 3 downward at a 90° angle as illustrated in FIGS. 1 and 2.

It may be noted that the plastic door 1 for the top shelf 5 in FIG. 1 would not have a doorstop above it for plastic door 1 to rest against. However the bottom bolt 24 in FIG. 2 attaching the top plastic door 1 to hinge 3 may be of appropriate length to rest against hinge 3 to support the top plastic door 1 at a proper inclined angle when the top plastic door 1 is in the closed position, the bottom bolt 24 thus becoming the doorstop, however this would only apply to the top plastic door 1.

Figure 4:
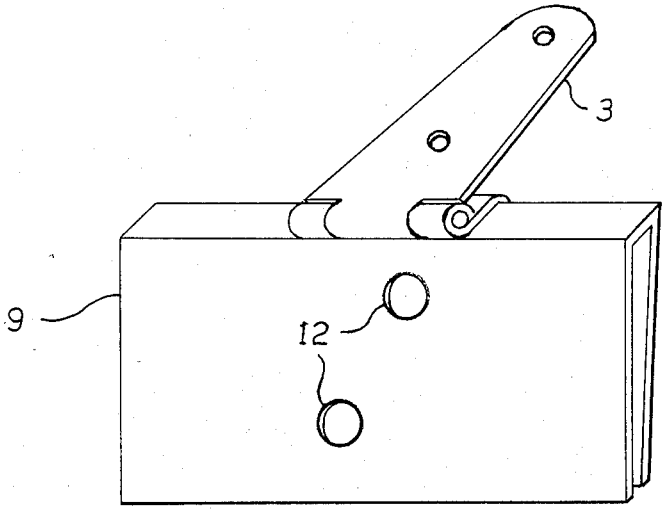
FIG. 4 is a bottom perspective view of the hinge assembly means of FIG. 3.

The bottom shelf in a Refrigerator is usually made of glass, with one or two crisper drawers located beneath the bottom glass shelf. FIG. 3 illustrates such a glass shelf 10, which has a rubber or plastic protective or trim cap 11 over the front edge. For this type of shelf a metal or plastic sleeve 9, about 3½" wide is formed to fit over and around the front edge of shelf 10, extending back from the front edge about 2" on the top and bottom of shelf 10, as illustrated in FIGS. 3 and 4. Hinge 3 is then riveted or spot welded to the top central portion of sleeve 9 as illustrated. Sleeve 9 fits tightly over the front edge of shelf 10, sleeve 9 being formed with a spring tension to grip plastic or rubber cap 11 and glass shelf 10 tightly to firmly hold sleeve 9 securely in place when placed over shelf 10, as illustrated in FIGS. 3 and 4. Two such sleeves 9 are provided for the two hinges 3 to which plastic door 1 is attached with bolts and nuts as previously described and illustrated, so that plastic door 1 may be mounted on glass shelf 10 as illustrated. FIG. 4 illustrates a bottom view of sleeve 9, showing two holes 12 of appropriate diameter and location to permit riveting or spot welding hinge 3 to the top surface of sleeve 9 after sleeve 9 has been formed. Sleeves 9 may be formed with sufficient spring tension so that the two rear edges of sleeve 9 press together and must be forced apart to fit over the front edge of shelf 10.

Figure 5:
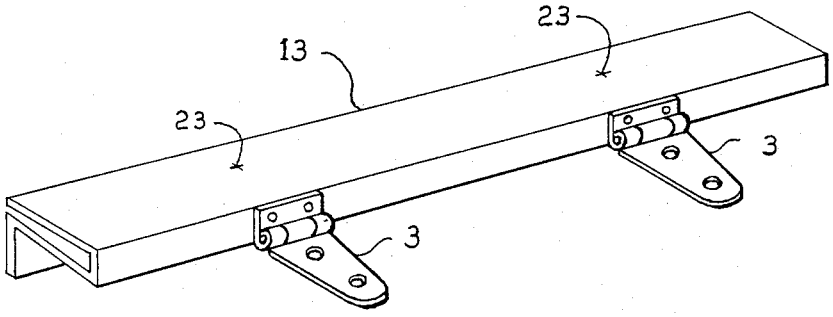
FIG. 5 is a perspective view of an alternative hinge assembly and doorstop means combined into a single unit for attaching the plastic doors to refrigerator or freezer shelves.
Figure 6:
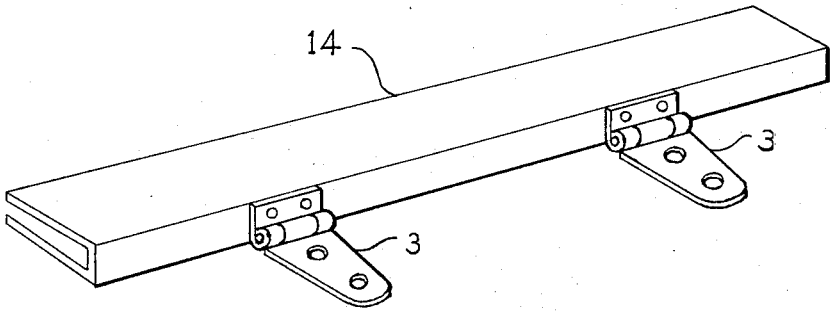
FIG. 6 is a perspective view of an alternative hinge assembly means for attaching the plastic doors to the bottom glass shelf of a refrigerator immediately above the crisper drawers.

Metal, plastic, or transparent plastic sleeves 13 and 14 in FIGS. 5 and 6 are similar to sleeve 9 of FIGS. 3 and 4, except that sleeves 13 and 14 are elongated so that two hinges 3 may be riveted or spot welded to the front edge of sleeves 13 and 14 as illustrated in FIGS. 5 and 6, (or similarly as illustrated in FIGS. 3 and 4), the two hinges 3 providing for attachment of plastic door 1 to the hinges 3 with bolts and nuts as previously described and illustrated. Sleeve 13 in FIG. 5 fits over the upper shelves in a Refrigerator, and is formed with the doorstop integrally combined beneath the sleeve 13 as illustrated. Thus sleeve 13 may be conveniently and easily slipped over the upper shelves of a Refrigerator, permitting convenient attachment of plastic doors 1 to hinges 3 with bolts and nuts as previously described. Metal cap 22 of shelves 5 in FIG. 1 might be removed or left in place, as desired, before slipping sleeve 13 over shelf 5. A hole may be drilled at each of two locations 23 of sleeve 13 in FIG. 5, through which to pass two bolts (or metal screws) of appropriate length and diameter to securely fasten sleeve 13 in position, nuts for the bolts being located on the bottom surface of sleeve 13. It might be preferred that sleeves 13 be made of transparent plastic to provide greater visibility.

Sleeve 14 is for the bottom glass shelf in a Refrigerator, so does not have a doorstop integrally combined beneath sleeve 14, as illustrated in FIG. 6, nor would any provision be made for fastening sleeve 14 in position with bolts, since the bottom shelf is usually glass. Plastic or rubber trim cap 11 over the front edge of glass shelf 10 in FIG. 3 might be removed or left in place, as desired, before slipping sleeve 14 of FIG. 6 over shelf 10. If plastic or rubber trim cap 11 were removed, sleeve 14 might be made in somewhat smaller dimension to merely replace trim cap 11.

In FIG. 3, hinges 3 could be riveted or spot welded to the front of sleeves 9 rather than the top of sleeves 9, similarly as hinges 3 are riveted or spot welded to the front of sleeve 14 in FIG. 6, although trim cap 11 would be maintained on the front edge of flass shelf 10 as illustrated in FIG. 3.

Figure 7:
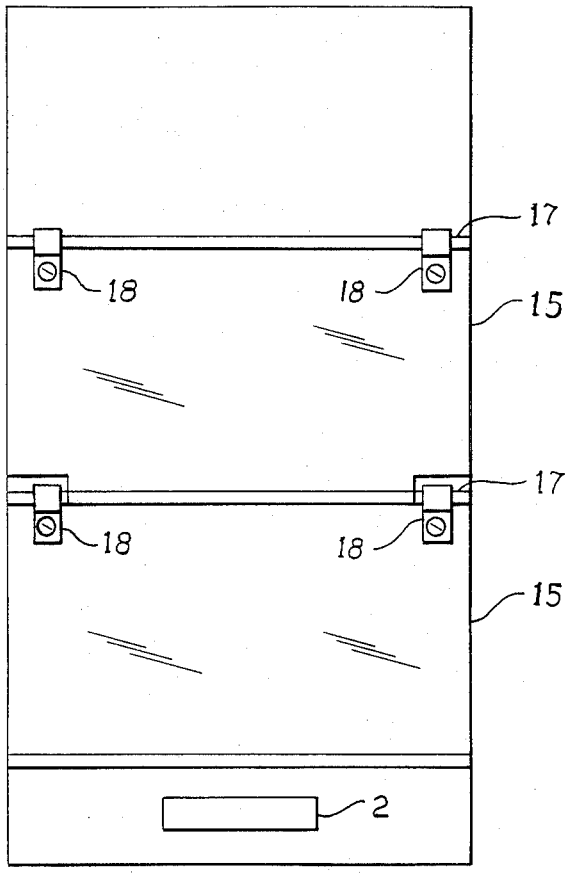
FIG. 7 is a front view of alternative simpler means for attaching the transparent plastic doors to the freezer shelves in a Side by Side Refrigerator-Freezer.
Figure 8:
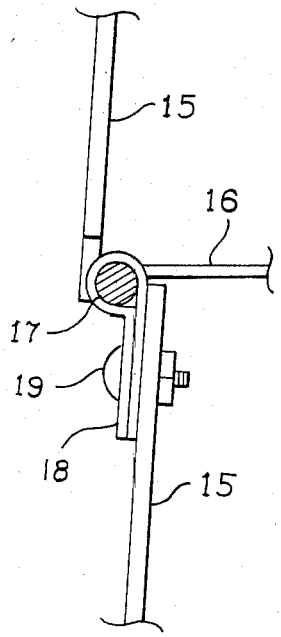
FIG. 8 is a side view detail of the hinge means of FIG. 7.

FIG. 7 illustrates an alternative means for attaching transparent plastic doors 15 to the individual shelves on the Freezer side of a Side by Side Refrigerator-Freezer. The shelves on the Freezer side of the Refrigerator do not have a decorative metal cap over round bar 17 at the front of the Freezer shelves. Therefore hinges 18 may be easily formed by merely bending a narrow strip of metal around round bar 17 in the manner illustrated in FIGS. 7, 8, and 9. FIG. 7 being a front view, FIG. 8 being a side view, and FIG. 9 being a top view illustrating round bar 17 at the front of shelf 16 with hinges 18. Plastic doors 15 are attached to hinges 18 by bolts 19 as illustrated in FIG. 8, and also FIGS. 7 and 9, plastic doors 15 being attached to the back side of hinges 18 and secured by nuts on bolt 19, so that plastic doors 15 may rotate on bar 17 as illustrated. The bottom edge of the upper shelf doors rest on round bar 17 of the shelf below, as illustrated in FIG. 8, the bottom edge of the upper shelf doors being flush with the bottom surface of bar 17 as illustrated, so that the upper shelf doors may be easily opened by touching the bottom edge of the shelves, and the upper shelf doors do not obstruct the opening of the lower shelf doors. A small rectangular cutout is provided at the bottom edge of the upper shelf doors 15 on each side to clear hinges 18 as illustrated in FIG. 7, so that hinges 18 do not bind on an upper shelf door 15 when a lower shelf door 15 is opened. It may be noted that the topmost shelf on the Freezer side does not have a shelf door, since there is not a round bar 17 above it on which to hang a door. Most of the cold air would be lost from the lower shelves without shelf doors anyway upon opening the normal outer Freezer door, so it would not be a significant disadvantage to leave the top shelf open. A rectangular shaped wood, plastic, or metal door handle 2 is centrally located near the bottom of the lower plastic door 15 in FIG. 7, door handle 2 being attached to plastic door 15 by two wood or metal screws, similarly as in FIG. 1. The door handle 2 in FIG. 7 is provided on the lower plastic door 15, since it would be difficult to reach the bottom edge of the lower plastic door 15 at the bottom of the Freezer to open door 15. Although sufficient clearance would be provided at the bottom and sides of the lower plastic door 15 from the Freezer casing to provide sufficient interior air circulation to the normal outside Freezer door when closed to maintain proper Freezer temperature to foods stored in the outside Freezer door. Thus FIG. 7 illustrates a simple and economical means for attaching plastic doors 15 to individual shelves on the Freezer side of a Side by Side Refrigerator-Freezer, which also has maximum visibility to the smaller shelves in the Freezer side. The open top shelf without a door as illustrated might even be preferred, since automatic ice making equipment is in the top shelf on the Freezer side.

Figure 9:
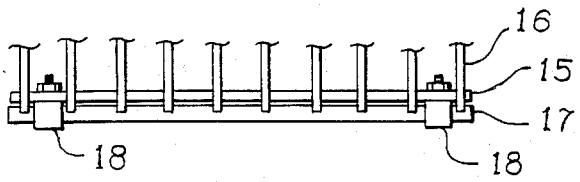
FIG. 9 is a top view detail of hinge means of FIG. 7.
Figure 10:
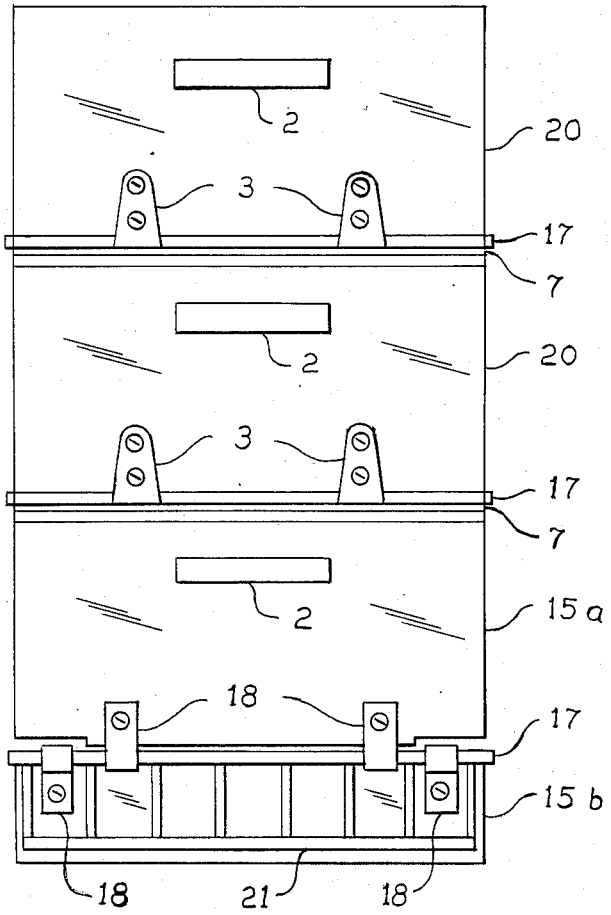
FIG. 10 is a front view of alternative means for attaching the transparent plastic doors to the freezer shelves in a Side by Side Refrigerator-Freezer in an inclined manner similar to the refrigerator section in FIG. 1.

FIG. 10 illustrates a combination of the means of FIG. 1 and FIG. 9 for attaching transparent plastic doors 15 and 20 to the individual shelves on the Freezer side of a Side by Side Refrigerator-Freezer. The upper plastic doors 20 are attached with hinges 3, similarly as illustrated for plastic doors 1 in FIG. 1, 2, or 5, and the lower plastic doors 15 are attached with hinges 18 similarly as illustrated for plastic doors 15 in FIGS. 7, 8, and 9. The lower shelf 21 in FIG. 10 is a wire grid basket type shelf as illustrated, with round bar 17 being at the front uppermost part of basket 21, such that the upper part of basket 21 would not be conformed to attach hinges 3 of the type illustrated in FIG. 1, 2, 3, 4, 5, or 6. Therefore hinges 18 are bent over round bar 17 of basket 21 in FIG. 10 as illustrated. The lower plastic door or panel 15*b* is attached to hinges 18 identically as illustrated in FIGS. 7, 8, and 9, to merely cover the lower portion of basket 21. The upper plastic door 15*a* is attached to two hinges 18 which are rotated upward 180° from the position in FIG. 8 on round bar 17 as illustrated in FIG. 10, the two hinges 18 of panel 15*b* being near the exterior ends of round bar 17, and the two hinges 18 of plastic door 15*a* being farther from the exterior ends of round bar 17 as illustrated. Plastic door 15*a* may be either attached to the back side of hinges 18 as illustrated, or attached to the front side of hinges 18 without any particular difference. The lower edge of plastic door 15*a* is positioned slightly above round bar 17 in the closed position, so plastic door 15*a* does not cause any obstruction with plastic door 15*b* when plastic door 15*a* is in the fully opened position. A slight rectangular cutout is provided at the bottom edge of plastic door 15*a* at each side as illustrated to clear hinges 18 of panel 15*b*.

Plastic doors 15*a* and 20 in FIG. 10 rest against doorstop 7 in an inclined position when closed, similarly as illustrated in FIGS. 1 and 2, rectangular door handles 2 being attached similarly as in FIG. 1. The top plastic door 20 in FIG. 10 has a doorstop on the hinges 3, similarly as described for FIG. 1. Since there is no metal decorative cap 22 on the front edge of the shelves in the Freezer section, the rear part of hinges 3 in FIG. 2 could be flattened out behind bend 26 to remove the offset when hinges 3 are used in the Freezer section, hinges 3 being bolted to doorstop 7 in FIG. 10 similarly as in FIG. 1. The hinge 3 assembly on sleeve 13 in FIG. 5 could also be used in FIG. 10 similarly as in FIG. 1, for plastic doors 20.

The wire grids of basket 21 in FIG. 10 extend horizontally back for about 1" from round bar 17 at the front before bending downward vertically as illustrated in FIG. 10. Therefore in FIG. 2 hinges 3 could be modified to fit on basket 21 by cutting off the rear portion of hinges 3 at offset bend 26, and drilling two holes in the front portion of hinges 3 at the X-marked positions 25 as illustrated in FIG. 2. For purposes of reference, the modified hinges 3 as described and illustrated in FIG. 2 will be referred to as modified hinges 3, for attachment to basket 21 in FIG. 10. Plastic panel 15*b* in FIG. 10 could be replaced by an L-shaped metal, plastic, or transparent plastic panel 15*c* (not illustrated) which is similar to doorstop 7 in FIG. 2, the wide portion of L-shaped panel 15*c* (not illustrated) covering the front portion of basket 21 in FIG. 10, and the narrow portion of L-shaped panel 15*c* (not illustrated) fitting beneath the top of basket 21, so that modified hinges 3 as described and illustrated could be bolted to the narrow top portion of L-shaped panel 15*c* (not illustrated), identically or similarly as hinges 3 are bolted to doorstop 7 in FIGS. 1 and 2. Thus the top portion of basket 21 in FIG. 10 would be sandwiched between the modified hinges 3 as described and illustrated and the narrow portion of L-shaped panel 15*c* (not illustrated). Plastic door 15*a* in FIG. 10 would then be attached to modified hinges 3 identically as plastic doors 20 are attached to hinges 3, the cutouts on each side at the bottom of door 15*a* no longer being required to clear eliminated hinges 18 of panel 15*b*.

The plastic doors and hinge means as described and illustrated in FIGS. 7, 8, 9, and 10, or the modification of FIG. 10 as described and illustrated, would be preferred for the Freezer section of a Side by Side Refrigerator-Freezer. The plastic doors and hinge means as described and illustrated in FIGS. 1, 2, 3, 4, 5, and 6 would be preferred for the Refrigerator section of a Side by Side Refrigerator-Freezer or a large vertical Freezer.

Since many changes could be made in the aforesaid construction and many apparently widely different embodiments of this invention could be made without departure from the scop thereof, it is intended that all matter contained in the above description or shown in the accompanying drawings shall be interpreted as illustrative and not in a limiting sense.

What is claimed is:

1. In a refrigerator, freezer, or side by side refrigerator-freezer, individual shelf means within said refrigeration units, normal outside door means for said refrigeration units; individual door means for said individual shelf means, said individual shelf door means being in addition to said normal outside door means, hinge means for said individual shelf door means, means to attach said hinge means near the bottom of said individual shelf door means, means to affix the axis of said hinge means for said individual shelf door means near the front edge of said individual shelf means, doorstop means for said individual shelf door means, said doorstop means permitting the top of each individual shelf door means to be recessed inwardly behind the front edge of the individual shelf means immediately above, handle means for said individual shelf door means, means to affix said handle means near the top of said individual shelf door means, said recessment of the top of said individual shelf door means inwardly behind the front edge of the individual shelf means immediately above providing an enhancement in the appearance of said individual shelf door means and said refrigeration units, said recessment of the top of said individual shelf door means further providing gravity action to keep the individual shelf door means in a closed position, said recessment of the top of said individual shelf door means further providing convenient space for said handle means for said individual shelf door means within said refrigeration units when said normal outside doors of said refrigeration units are in a closed position, said individual shelf door means being transparent, opening of said individual shelf door means for removal of food providing a minimal loss of cold air from said refrigeration units, said transparent individual shelf door means permitting convenient selection of foods to be removed without hurriedly closing said normal outside door means of said refrigeration units.

2. The apparatus of claim 1 including L-shaped means, means to attach a horizontal flange of said L-shaped means to the bottom of said individual shelf means, a vertical flange of said L-shaped means being located in a recessed position behind the front edge of said individual shelf means to which it is attached, the top of each said individual shelf door means immediately below said L-shaped means resting against said vertical flange of said L-shaped means when said individual shelf door means is in the closed position, said L-shaped means thus providing a doorstop for each said individual shelf door means immediately below said L-shaped means whereby the top of each said individual shelf door means is recessed inwardly behind the front edge of the individual shelf means immediately above, the resting of each said individual shelf door means against the vertical flange of said L-shaped means further providing an air seal to restrict the loss of cold air from said individual shelf door means in the closed position when said normal outside door means of said refrigeration unit is opened.

3. The apparatus of claim 1 wherein said handle means for said individual shelf door means is rectangular in shape, means to affix the longitudinal axis of said rectangular handle means in a horizontal position near the middle top portion of said individual shelf door means.

4. The apparatus of claim 2 including means to attach said hinge means for said individual shelf door means to said L-shaped means.

5. The apparatus of claim 1 including different dimensions of said individual shelf door means for different sizes of said refrigeration units.

6. The apparatus of claim 1 including different dimensions of said individual shelf door means for said individual shelf means in accordance to desired heights of said individual shelf means within said refrigeration units.

7. The apparatus of claim 1 including means to lower the edge of said individual shelf door means below said individual shelf means when said individual shelf door means are fully opened, thus preventing accidental breakage of said individual shelf door means by food being removed from said individual shelf means.

8. The apparatus of claim 7 wherein the axis of said hinge means for said individual shelf door means is near the bottom surface of said individual shelf means, the edge of said individual shelf door means being recessed below the top surface of said individual shelf means when said individual shelf door means are fully opened.

9. The apparatus of claim 1 including sleeve means, means to attach said hinge means to said sleeve means, said sleeve means fitting snugly over the front edge of said individual shelf means to securely hold said hinge means in proper position, means to attach said individual shelf door means to said hinge means.

10. The apparatus of claim 9 wherein spring tension in said sleeve means firmly hold said sleeve means in proper position on said individual shelf means.

11. The apparatus of claim 9 wherein fastening means firmly hold said sleeve means in proper position on said individual shelf means.

12. The apparatus of claim 2 wherein sleeve means are integrally combined with said L-shaped means, means to attach said hinge means to said sleeve means, said sleeve means fitting snugly over the front edge of said individual shelf means to securely hold said hinge means in proper position, means to attach said individual shelf door means to said hinge means.

13. The apparatus of claim 12 wherein spring tension in said sleeve means firmly hold said sleeve means in proper position on said individual shelf means.

14. The apparatus of claim 12 wherein fastening means firmly hold said sleeve means in proper position on said individual shelf means.

15. The apparatus of claim 1 on the refrigerator side of a side by side refrigerator-freezer, said individual shelf means on the freezer side of said side by side refrigerator-freezer having a round bar at the front of said individual shelf means, strap means, said strap means formed around said round bar to form strap hinge means, means to attach said individual shelf door means to said strap hinge means, said individual shelf door means attached to said strap hinge means on the freezer side of said side by side refrigerator-freezer being held in a closed position by gravity against the front edge of said shelf means immediately below, means to conveniently open said individual shelf door means on the freezer side of said side by side refrigerator-freezer.

16. The apparatus of claim 1 including strap means, said strap means formed around a round bar at the front of said individual shelf means, said strap means providing hinge means for said individual shelf door means, means to attach said individual shelf door means to said strap hinge means.

* * * * *